US008800328B2

(12) United States Patent
Dubbey

(10) Patent No.: US 8,800,328 B2
(45) Date of Patent: Aug. 12, 2014

(54) SECURITY DEVICE

(76) Inventor: Martin Lewis Dubbey, London (GB)

( * ) Notice: Subject to any disclaimer, the term of this patent is extended or adjusted under 35 U.S.C. 154(b) by 42 days.

(21) Appl. No.: 13/441,204

(22) Filed: Apr. 6, 2012

(65) Prior Publication Data

US 2012/0255332 A1 Oct. 11, 2012

(30) Foreign Application Priority Data

Apr. 8, 2011 (GB) ..... 1106061.3
Feb. 29, 2012 (GB) ..... 1203586.1

(51) Int. Cl.
*E05B 73/00* (2006.01)

(52) U.S. Cl.
USPC ..... 70/14; 70/19; 70/209; 292/259 R

(58) Field of Classification Search
USPC ..... 70/14, 19, 209; 292/258, 259 R, 288, 292/289
See application file for complete search history.

(56) References Cited

U.S. PATENT DOCUMENTS

| | | | | | |
|---|---|---|---|---|---|
| 2,140,066 | A * | 12/1938 | White | 70/14 |
| 2,556,900 | A | 6/1951 | Buschhorn | |
| 3,664,164 | A * | 5/1972 | Zaidener | 70/202 |
| 3,955,841 | A * | 5/1976 | Walker | 292/259 R |
| 4,003,227 | A * | 1/1977 | Casey | 70/14 |
| 4,958,867 | A * | 9/1990 | Champagne | 292/259 R |
| 5,203,597 | A | 4/1993 | Wheelock | |
| 5,209,533 | A | 5/1993 | Menard | |
| 5,419,165 | A | 5/1995 | Perkins | |
| 5,447,346 | A | 9/1995 | Virzi | |
| 5,862,688 | A * | 1/1999 | Odegard | 70/19 |
| 6,553,797 | B2 | 4/2003 | Witchey | |
| 6,755,450 | B1 * | 6/2004 | Chen | 292/295 |
| 7,278,663 | B2 | 10/2007 | Witchey | |
| 8,191,851 | B2 * | 6/2012 | Crown | 248/553 |
| 2009/0031765 | A1 * | 2/2009 | Liu | 70/209 |
| 2010/0244467 | A1 * | 9/2010 | Asen | 292/259 R |

FOREIGN PATENT DOCUMENTS

| | | | |
|---|---|---|---|
| DE | 372 619 | C | 3/1923 |
| DE | 20 2010 014234 | U1 | 2/2011 |
| FR | 2674563 | A1 | 3/1991 |
| JP | 2000 226061 | A | 8/2000 |
| WO | WO 96/17755 | A1 | 6/1996 |
| WO | WO 2008/078985 | A1 | 7/2008 |

OTHER PUBLICATIONS

Combined Search and Examination Report, Application No. GB1203586.1, 7 pages, Search dated May 8, 2012.
Search Report, Application No. GB11060613, 4 pages. Search dated Jul. 7, 2011.
European Search Report, Application No. 12163248.3-1603 /2584127, mailed Apr. 11, 2014, 6 pages.

* cited by examiner

*Primary Examiner* — Suzanne Barrett
(74) *Attorney, Agent, or Firm* — Patterson Thuente Pedersen, P.A.

(57) ABSTRACT

A security device for hindering the unauthorized opening of safes includes first and second, retractably cooperable longitudinal members. First and second lateral members are provided at respective outer ends of the longitudinal members. A locking mechanism locks the first longitudinal member to the second longitudinal member. A tension spring retractably biases the second longitudinal member into the first longitudinal member. The locking mechanism can include a clamping member swivellably attached to the first longitudinal member and containing a pawl member, while the second longitudinal member includes a sawtoothed element. The clamping member can then be swiveled, so as to push the second longitudinal member further into the first longitudinal member. A vernier arrangement may be included to further tighten the lateral members against the walls of the safe. The device provides, firstly, a visible deterrent and, secondly, a physical barrier to would-be intruders.

7 Claims, 13 Drawing Sheets

SECURITY DEVICE

RELATED APPLICATIONS

The present application claims priority to GB Application No. 1106061.3 filed Apr. 8, 2011 and GB Application No. 1203586.1 filed Feb. 29, 2012, each of which is hereby fully incorporated herein by reference.

BACKGROUND OF THE INVENTION

The present invention relates to a security device for hindering access to a safe, and in particular a hotel safe, by a potential thief.

It is common practice for travellers to keep their valuables locked away in a safe, when they stay at hotels. Indeed, many hotels usually provide individual safes in their rooms for this purpose.

Unfortunately, while travellers are often under the impression that such safes provide good protection for their valuables, the reality may be different. As can all too often occur, a corrupt member of the hotel staff, a thief or even a local government official can easily compromise a typical hotel safe in seconds, in order to either steal or simply gain access to, stored valuables or sensitive documents. Since there may be over 88 million hotel rooms available each night worldwide, it is clear that the potential threat to the travelling public's security is considerable.

In the case of low-level crime, the theft will be obvious. Some or all of a traveller's valuables will be missing. What is possibly a greater threat, however, is an attempt on the part of a thief to keep their activity secret. This may take the form of simply removing a couple of banknotes from a locked-away wallet every other night, or—which is far more dangerous—stealing the traveller's identity. This may involve the stealing of credit-card details, laptop contents or passport and business information. The victim will generally not be aware that anything has happened. Consequently he will not be in a position to take remedial action, until it is too late.

While the ordinary traveller is at risk from such activity, it is business people who are particularly prone to having their valuables stolen by organized crime or government agencies. Travelling government officials may also have official secrets copied and their identity compromised. Other types of vulnerable possessions include documents relating to intellectual-property and database details of third parties. Information of this type could prove highly embarrassing if compromised, and could lead to legal claims on the part of such third parties.

It is in view of the urgent need for some kind of preventative measure, that the present invention was developed. The present invention provides, firstly, a visible deterrent and, secondly, a physical barrier to would-be intruders, allowing a hotel guest peace of mind when valuables are left behind.

SUMMARY OF THE INVENTION

In accordance with a first aspect of the present invention, there is provided a hotel-safe security device for hindering the unauthorized opening of hotel safes, the device comprising a first longitudinal member and a second longitudinal member, the second longitudinal member being retractably co-operable with the first longitudinal member; first and second lateral members at respective outer ends of the first and second longitudinal members, the first and second lateral members being for clamping against side-portions of the hotel safe; a resilient member attached at one end to the first longitudinal member and at its other end to the second longitudinal member, the resilient member being such as to bias the second longitudinal member into retraction with respect to the first longitudinal member, and a locking mechanism for locking the first longitudinal member to the second longitudinal member in a clamped state of the device against the hotel safe.

The locking mechanism may include a sawtoothed element as part of the second longitudinal member, and a pawl member having a first end, which is pivotably attached to the first longitudinal member and a second end, which is engageable with a tooth of the sawtoothed element.

Provision of such a sawtoothed element enables fine control of the clamping pressure against the safe to be achieved, particularly if the teeth are fairly fine.

The locking mechanism preferably includes a swivellable clamping member, which is swivellably attached to the first longitudinal member, the swivellable clamping member being selectively swivellable to a first position, in which the second end of the pawl is in engagement with a tooth of the sawtooth element, and to a second position, in which the second end of the pawl is out of engagement with the tooth of the sawtooth element, the first end of the pawl being swivellably attached to the swivellable clamping member and biasing means being provided to bias the second end of the pawl toward the tooth of the sawtooth element, the locking mechanism being such that, when the hotel-safe security device is in place against a hotel safe and the swivellable clamping member is swiveled from its second position to its first position, the second end of the pawl engages with the tooth of the sawtooth element and moves the second longitudinal member into further retraction with respect to the first longitudinal member, thereby tightly clamping the lateral members to the sides of the hotel safe.

Provision of the clamping member allows the user to easily exert the required pressure on the second longitudinal member relative to the first longitudinal member, in order to securely clamp the lateral members against the sides of the safe.

The security device may further comprise an adjustment mechanism for moving the second longitudinal member into even further retraction with respect to the first longitudinal member, when the swivellable clamping member is in its first position.

This allows the clamping pressure to be increased further following movement of the clamping member into its first position.

The adjustment mechanism may comprise a vernier means, to which is swivellably attached the first end of the pawl, and which is slideably attached to the clamping member.

Provision of a vernier means allows fine control of the further increase in pressure.

The vernier means may comprise a threaded member, to which the first end of the pawl member is swivellably attached, and which is movable in a direction parallel to the longitudinal direction of the first and second longitudinal members when the clamping member is in its first position. The vernier means may comprise a nut in engagement with the threaded member, the nut being turnable through an opening in the clamping member.

This measure enables a user to readily apply the increased pressure of the lateral members against the sides of the safe, using a simple spanner-type tool, which may be supplied along with the security device.

The first end of the pawl member may be swivellably attached to the threaded member by means of a pin passing through the threaded member, the pin being journalled in a slotted hole provided in the clamping member, the slotted hole allowing the pawl to move in a longitudinal direction as the nut is turned.

The locking mechanism preferably further comprises a lock device, which is attached to the clamping member and has a lug, which can be turned by operation of the lock device when the clamping member is in its first position, the lug engaging with the first longitudinal member and thereby locking the clamping member into its first position. A cover member may also be provided, which is slideably attached to the clamping member, such that, when the lock device is operated so as to lock the clamping member into its first position, the lock device also slides the cover member toward and over the nut member, thereby preventing access to the nut member.

The lock device can comprise a key, which is unique to the particular user and therefore provides enhanced security. The cover member discourages a thief from contemplating weakening the grip of the lateral members against the safe by tampering with the nut.

The inner surfaces of the first and second lateral members may be provided with a gripping surface for establishing a firm grip with the side-portions of the safe. The gripping surface is advantageously formed of a resilient material and may comprise a two-dimensional array of raised points.

The first and second lateral members may be selectively arranged to be of a longer length to suit a stand-alone type of safe or of a shorter length to suit a wall-mounted safe. In this case, the first and second lateral members are pivotably attached to the respective first and second longitudinal members, and the first and second lateral members each comprise a long section for use with a stand-alone type of safe and a shorter section for use with a wall-mounted safe; the first and second lateral members can then be selectively moved through 180°, so that either the long section or the shorter section faces the safe.

As an alternative to the arrangement just described, the first and second lateral members may comprise a stub section for use with a wall-mounted safe, and a detachable extension section for use with a stand-alone type of safe, the detachable extension section being engageable with the stub section and having a locking element for locking the detachable extension section to the stub section.

In the security device according to the invention described above, the first longitudinal member may have a longitudinal opening on its rear side facing a safe, with which the device is to be used, and a rear side of the second longitudinal member lies flush with the outside of said longitudinal opening. In a particular realization of this arrangement, the first longitudinal member is provided with one or more protrusions extending toward the inside of the first longitudinal member, and the second longitudinal member is provided with one or more recesses which engage with the one or more protrusions, thereby to prevent the second longitudinal member from migrating out of the opening of the first longitudinal member.

The locking mechanism used with the security device may include either a conventional key-type lock, or a biosensor lock for sensing a biometric parameter of the user.

In a second aspect of the present invention, a method of use of a hotel-safe security device is provided, the security device being as defined above and including the swivellable clamping member. The method of use comprises offering the security device up to the safe, so that the first and second lateral members are adjacent the sides of the safe and spaced therefrom, the swivellable clamping member being in its second position; allowing the first and second longitudinal members to retract with respect to each other, thereby causing the first and second lateral members to grip the sides of the safe under the action of the resilient member; moving the swivellable clamping member from its second position to its first position; and operating the lock device, so that the lug engages with the first longitudinal member.

When access to the safe contents is desired, the method further comprises operating the lock device, so that the lug comes out of engagement with the first longitudinal member; moving the swivellable clamping member from its first position to its second position; moving the first and second longitudinal members out of retraction with respect to each other, so that the first and second lateral members come clear of the sides of the safe; pulling the security device away from the safe, and allowing the first and second lateral members to retract fully with respect to each other.

BRIEF DESCRIPTION OF THE DRAWINGS

Embodiments of the present invention will now be described, by way of example only, with reference to the appended drawings, which show.

DETAILED DESCRIPTION OF THE EMBODIMENTS

Figure 1:
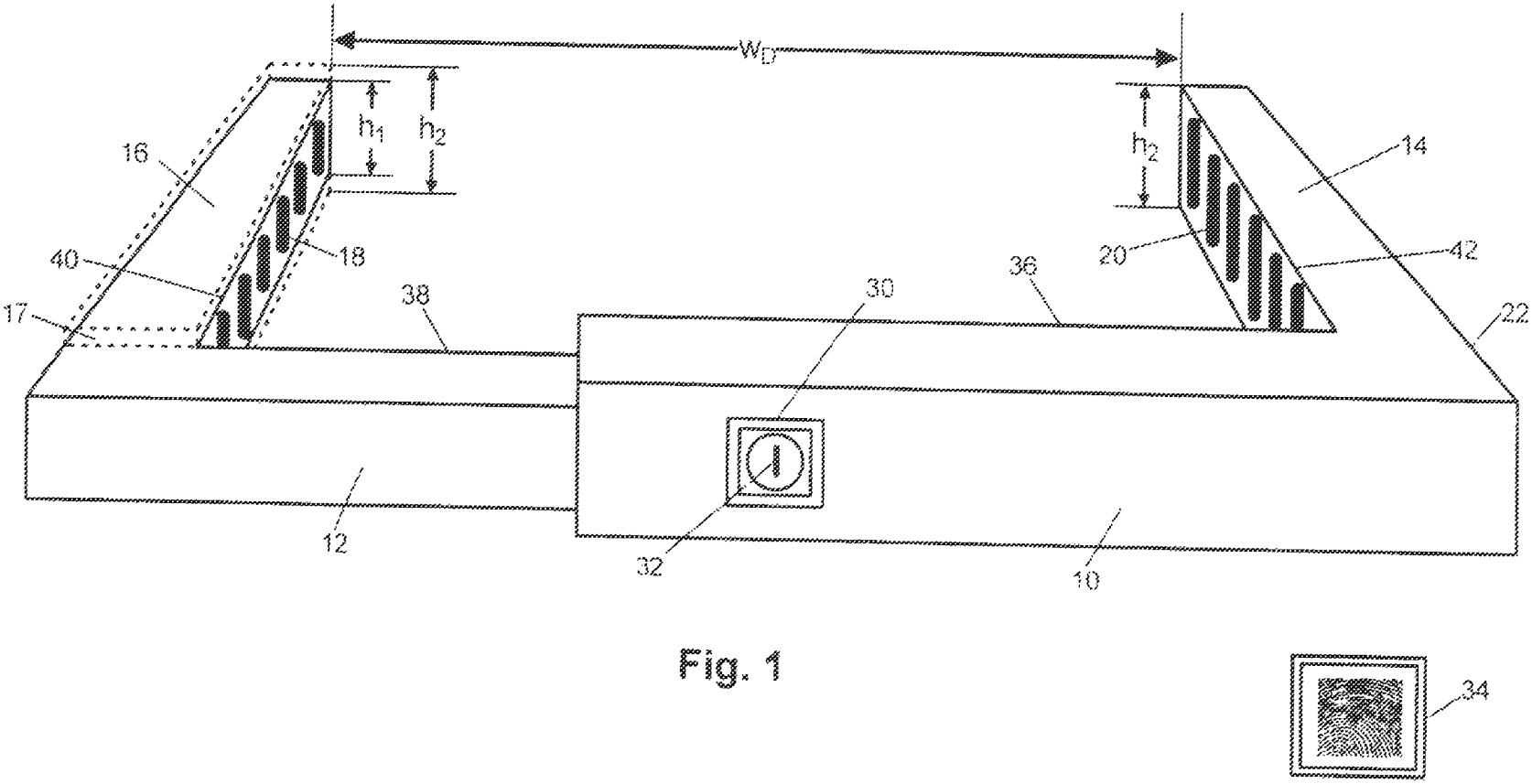
FIG. 1 is a perspective view of a security device according to an embodiment of the invention.

A security device according to an embodiment of the invention is shown in perspective view in FIG. 1. The device comprises a first longitudinal member 10 and a second longitudinal member 12. The second longitudinal member 12 is received in, and can slide in and out of, the first longitudinal member 10. Extending in a direction perpendicular to the longitudinal direction of both of the longitudinal members 10, 12 are a pair of lateral members 14 and 16, which extend from respective outer ends of the two longitudinal members. In the preferred embodiment these lateral members are integral with their respective longitudinal members, but may alternatively be separate items, which are secured to the longitudinal members by any suitable means. In choosing such suitable means care must be taken to ensure that the integrity of the device is not compromised. Thus, for example, if the lateral members 14, 16 are screwed onto the ends of the longitudinal members, it must not be possible for a thief to readily access the screw heads, thereby enabling him to take the device apart. It is for this reason that an integral design is preferred.

The inside surface of each lateral member 14, 16 is arranged to have a ribbed configuration 18, 20, the ribbing being slightly resilient. This enables the device, in use, to be tightly clamped against the sides of the safe, making it very difficult for a thief to remove it. One suitable material for the ribbing is a resin, though other materials may also be employed, e.g. a fairly hard rubber. The surface of the material used may be roughened, in order to provide a better grip.

The two lateral members 14, 16 have, as shown by the solid lines, a respective height $h_1$, $h_2$, which is the same as the height of their associated longitudinal members 10, 12. This means that the surface area of the ribbing 18 of the lateral member 16 is less than that of the ribbing 20 of the lateral member 14, which may be undesirable. To overcome this, the invention envisages the use of a lateral member 16 identical to the lateral member 14. This would be as shown by the dotted lines in FIG. 1, and would involve the presence of a shoulder 17 on the upper and lower sides of the lateral member 16. The shoulder could either continue to the front surface of the longitudinal member 12, or stop at its rear surface, as shown. The latter is preferred, for security reasons. This will be discussed later.

In an embodiment of the invention the second longitudinal member 12 is arranged to automatically retract within the first longitudinal member 10, when the device is not applied to a safe. This can be achieved by disposing a tension spring inside the first longitudinal member 10, the ends of the spring being attached to, at one end, the inner end of the second longitudinal member 12 and, at the other end, to the inside wall at the outer end 22 of the longitudinal member 10.

In order to allow the device to be removed from a safe by an authorized user, a locking mechanism is provided on the first longitudinal member 10. This includes a lock 30, which will normally take a key, which is inserted into a slot 32 in the conventional manner. An alternative measure, which might appeal to big corporations and travelling government officials, is to use a biometric lock, as shown representationally as item 34 in FIG. 1. This would be opened by, for example, placing the user's fingerprint against the front surface of the lock. Suitable circuitry would be provided inside the device, which would compare an image of this fingerprint against a stored authorized fingerprint image, allowing the second longitudinal member to be pulled out of the first longitudinal member, and the device removed from the safe, if these two images corresponded to each other. This would, of course, necessitate the inclusion of a battery inside the device. The best place for this, and indeed for the circuitry, is inside the first longitudinal member 10 at its outermost end as it meets the lateral member 14.

Figure 2:
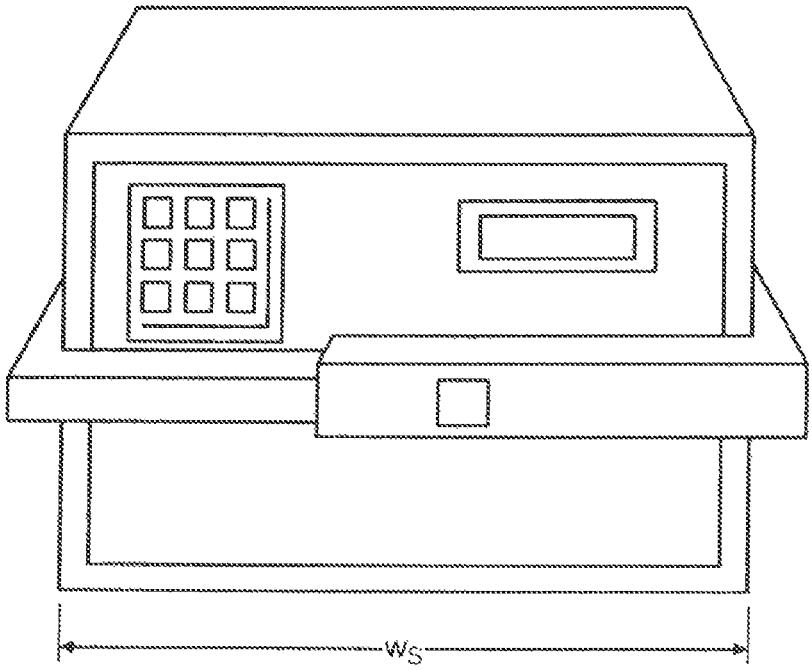
FIG. 2 is a perspective view of the security device of FIG. 1, as deployed with a typical hotel safe.

FIG. 2 shows the device, as deployed to protect a safe. Here it is assumed that the safe is a secured item kept in a storage cupboard, or similar, in a hotel room. To deploy the device, and assuming that the device is initially in its fully retracted state, the key for the lock mechanism 30 is inserted into the key slot 32 (see FIG. 1) and turned. This releases the locking mechanism inside the first longitudinal member 10, thereby allowing the second longitudinal member 12 to be extended out of the first longitudinal member 10. The user then extends the second longitudinal member 12 out of the first longitudinal member 10 against the force of the spring to such an extent, that the distance $w_D$ between the ribbed inside surfaces of the lateral members 14 and 16 (see FIG. 1) is slightly greater than the outside width $w_S$ of the safe (see FIG. 2), and then offers the device up to the safe, so that the rear surface 36 of the first longitudinal member 10, and ideally also the rear surface 38 of the second longitudinal member 12 (see FIG. 1), abut up to the front of the safe. The key is then released, allowing the tension spring to pull the second longitudinal member 12 further into the first longitudinal member 10. This causes the slightly resilient ribbed parts 18 of the lateral members 14 and 16 to be slightly compressed, thereby holding the inside walls 40, 42 of the lateral members close to the side walls of the safe. To ensure a tighter grip, the user may proactively also exert some force himself, so as to hold the lateral members even closer to the safe walls. The device is arranged then to keep the device in that position—that is, with that particular relative positioning between the two longitudinal members. The device is thus locked in place against the front of the safe, acting as a deterrent to a thief.

When the authorized user wishes to gain access to the safe, he simply inserts his key into the slot 32 and turns the key. This releases the locking action between the two longitudinal members, allowing him to move the second longitudinal member further out of the first longitudinal member and thereby pull the device away from the safe. Once away from the safe, the device automatically retracts the second longitudinal member 12 into the first longitudinal member 10 until the device is needed again. The amount of retraction is such that the minimum width $w_D$ is less than the width $w_S$ of the safe in question. Indeed, the device is preferably designed so that this minimum width is less than the width $w_S$ of any safe, with which the device is likely to be deployed. Typically, the device will be dimensioned so as to extend to at least a width of around 450 mm, which would accommodate the latest safes designed to accept a laptop. A more usual width, however, might be around 350 mm for older safes. As regards the length of the lateral members, it is envisaged that these will be between around 80-100 mm. The choice of length is determined by, on the one hand, a need for a sufficient gripping action of the lateral members against the walls of a safe and, on the other hand, the need to reduce size and weight for portability purposes.

Figure 3A:
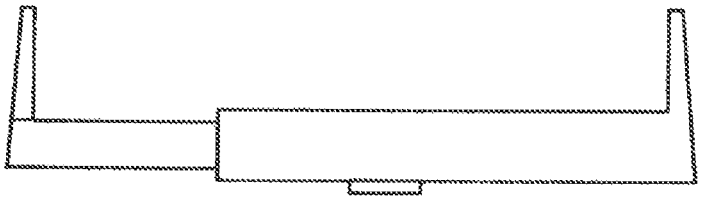
FIGS. 3(*a*) and 3(*b*) are plan views of the security device of FIG. 1 in two operating states thereof.
Figure 3B:
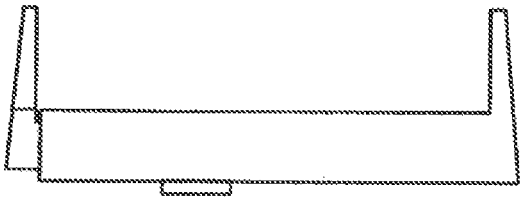

FIGS. 3(*a*) and 3(*b*) are plan views showing the device in, respectively, an extended state and a retracted state.

One possible way of realizing the locking action between the two longitudinal members 10 and 12 will now be explained with the aid of FIGS. 4(*a*) and 4(*b*).

Figure 4A:
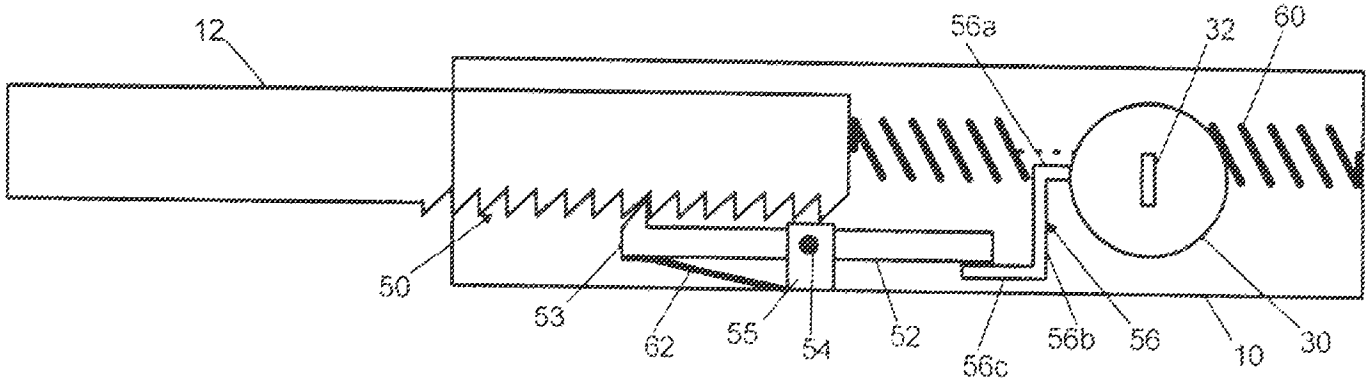
FIGS. 4(*a*) and 4(*b*) are side and plan views of a first embodiment of a locking mechanism, as employed with a security device according to the present invention.
Figure 4B:
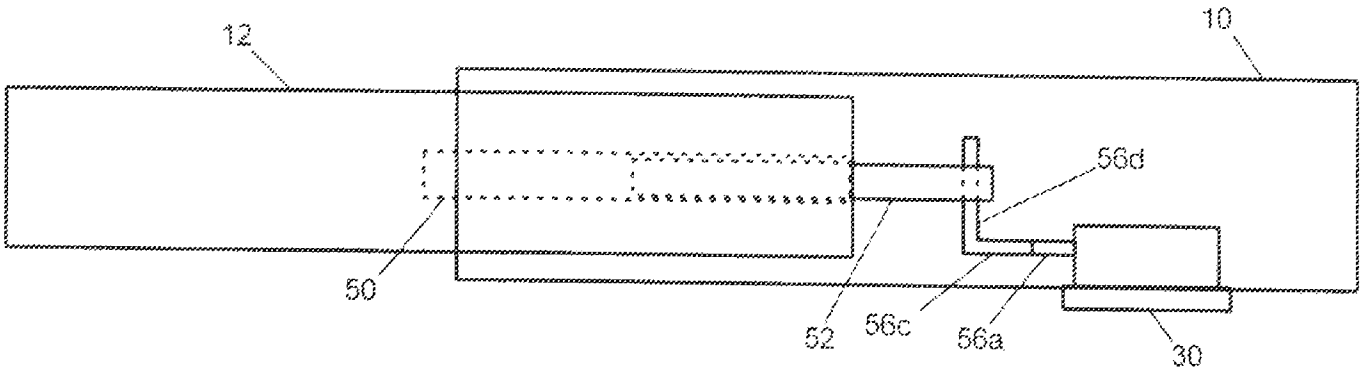
Figure 5A:
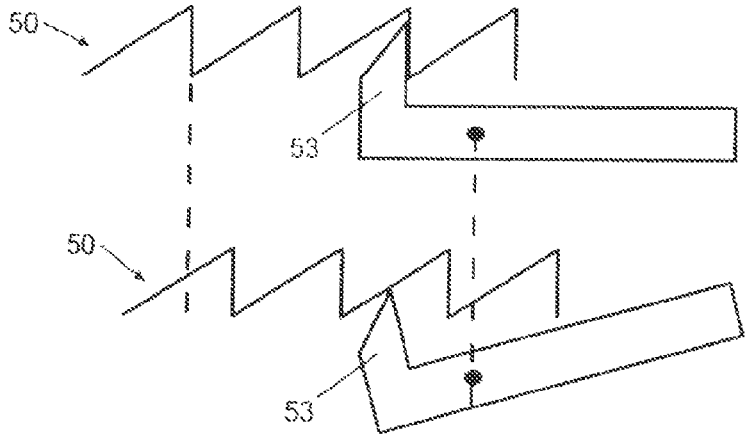
FIGS. 5(*a*)-5(*e*) are variants of the part of the locking mechanism illustrated in FIGS. 4(*a*) and 4(*b*)
Figure 5B:
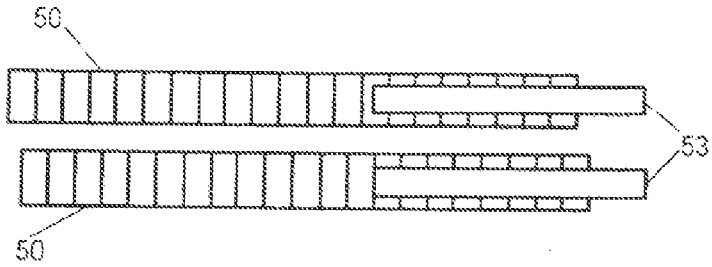
Figure 5C:
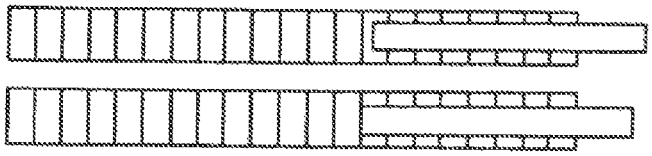
Figure 5D:
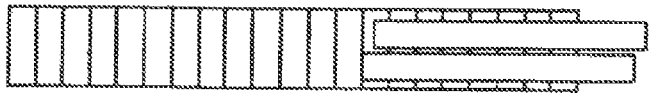
Figure 5E:
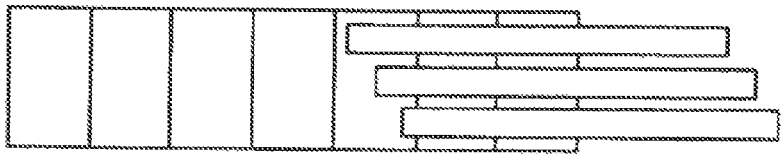
Figure 6A:
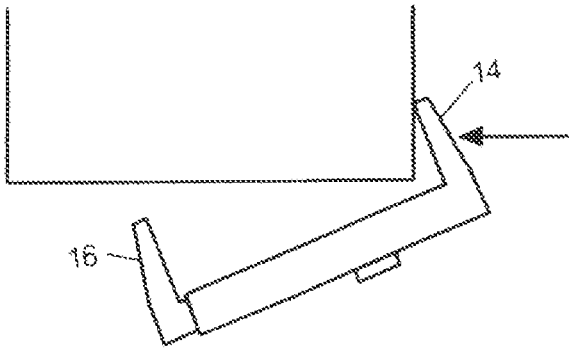
FIGS. 6(*a*)-6(*d*) are stages in one method of deploying the security device according to the present invention with a typical hotel safe.
Figure 6B:
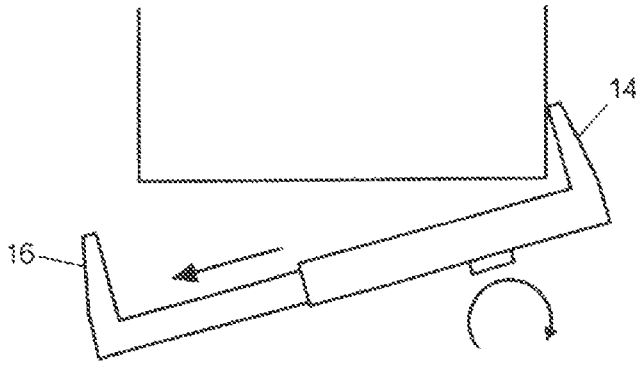
Figure 6C:
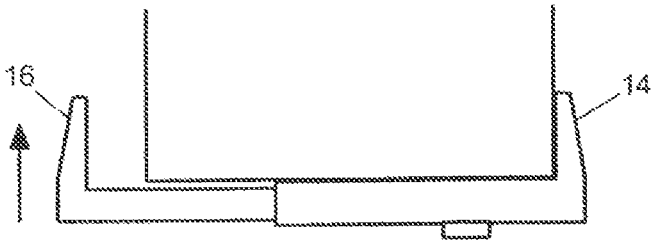
Figure 6D:
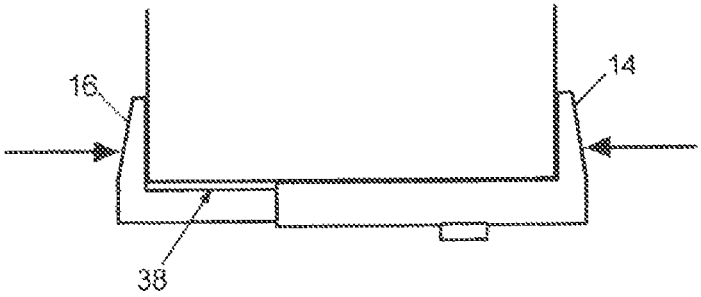

FIGS. 4(*a*) and 4(*b*), which are side and plan views, respectively, of a security device according to the invention, show the second longitudinal member 12 part-way engaged with the first longitudinal member 10. The second longitudinal member 12 has on its underside a sawtooth element 50, which extends over as much of the second longitudinal member, as will be necessary to ensure that the device can be extended sufficiently to accommodate the widest safe of interest, while still being lockable by the locking mechanism. Engaging with the sawtooth element 50 is a pawl lever 52, which is pivoted at a point 54. The pivot is formed of a U-shaped bracket 55 attached to the bottom floor of the second longitudinal member 10, and a pin, which passes through holes formed in the bracket and a hole formed in the pawl lever 52. In practice, the bracket may not be U-shaped, but L-shaped, in which case the pin is held cantilever-style and may, in fact, be integral with the L-shaped bracket. Alternatively the pin may be received in holes formed in the two opposite walls of the first longitudinal member 10. In order to ensure security, the hole in the front wall of this member (the wall containing the lock 30) would be blind, while the hole in the rear wall 36 would be open. This would allow the pin to be inserted from the rear, through the hole in the pawl lever and into the blind hole in the front wall. The left hand end of the pawl lever is formed into the shape of a pawl 53, which engages with the sawtooth element, while the right hand end engages with a lock lever 56.

The lock lever, which is connected to, and operated by, the lock 30, has a first section 56*a* parallel to the longitudinal axis of the longitudinal members, a second section 56*b*, which drops down at right-angles to the first section 56*a*, a third section 56*c*, which extends in the longitudinal direction, and a fourth section 56*d*, which extends again in the transverse direction. Also shown is the tension spring 60 (shown for convenience in the side view only), which biases the second longitudinal member 12 into its retracted position inside the first longitudinal member 10. A leaf spring 62 is also used to bias the pawl against the sawtoothed element. One end of this leaf spring is anchored to the bottom wall of the first longitudinal member 10, while its other end engages with the underside of the pawl end of the pawl lever 52.

In use, and in its non-deployed state, the spring 60 draws the second longitudinal member 12 ideally all the way into the first longitudinal member 10. As the second longitudinal member retracts into the first longitudinal member, the pawl 53 rides over the teeth of the sawtooth element 50 until the whole of the second longitudinal member 12 is fully inside the first longitudinal member 10. The pawl 53, in co-operation with the spring 62, then prevents the second longitudinal member 12 from being pulled out from that retracted position.

When it is desired to apply the device to a safe, a key is inserted into the slot 32 and turned. This turns the lock lever 56 clockwise, so that the lever section 56*d* rises, turning the pawl lever 52 counterclockwise on its pivot 54 and releasing the pawl from engagement with the sawtoothed element 50. At this point the user pulls out the second longitudinal member 12 to a sufficient width and offers the device up to the safe, so that the lateral members 14 and 16 embrace the side-walls of the safe. As explained already above, the lateral members are released and allowed to grip those side-walls. This results in the second longitudinal member 12 retracting a little further into the first longitudinal member 10, allowing the pawl to engage with a tooth nearer the outer end (left hand end) of the sawtooth element 50. If the lateral members are at the same time forcibly brought together by an applied force, then the further compression of the ribbing 18, 20 on the lateral members may cause the pawl to engage with yet another one or more teeth, as the second longitudinal member is forced still further into the first longitudinal member. The result is that the two longitudinal members are tightly locked together and the inside walls 40, 42 (see FIG. 1), from which the ribbing 18, 20 normally stands proud, are either in contact with, or are spaced only very slightly apart from, the side-walls of the safe. This, together with the correct positioning of the device, so that the rear wall of at least the first longitudinal member is in contact with the front wall of the safe, ensures that a potential thief cannot insert a jimmy or similar instrument between the device and the safe, thereby to disengage the device from the safe.

The locking mechanism just described should ideally meet two requirements: firstly, that it be strong enough to prevent the second longitudinal member from being forced out of the first longitudinal member; secondly, that it provide a fine resolution of locking points. The latter is useful, in that it can provide a tight clamping action of the device against the safe. In practice, this means that the sawtooth element 50 should be strong and also have fine teeth—i.e. the pitch of the teeth should be small. Unfortunately, these two requirements cannot be met simultaneously in this design, since small teeth are intrinsically weaker than larger teeth, yet larger teeth are spaced further apart, which reduces the locking resolution.

However, these conflicting requirements can both be met by a variant of the FIG. 4 design. This is illustrated in FIGS. 5(*a*)-5(*d*), in which instead of a single sawtooth element 50, two such elements are provided. The teeth of these two elements have twice the pitch of the sawtooth element 50 shown in FIG. 4, but the peaks of the teeth of one element lie midway between the peaks of the teeth of the other element. Two pawl levers 52 are provided, which are in line with each other, such that, while the pawl 53 of one lever is engaged with the trough of a tooth in the upper element 50, the pawl 53 of the other lever lies between the peak and the trough of a tooth in the lower element (see FIG. 5(*a*)).

As illustrated in FIG. 5(*b*), the two sawtooth elements 50 can be arranged side-by-side next to each other, as can the two pawl levers 52. Each pawl lever will have its own leaf spring 62.

As an alternative to this (see FIG. 5(*c*)), the two sawtooth elements 50 are arranged side-by-side so that their teeth are in line with each other. Thus, the peaks of the teeth of the two elements coincide with each other. This time, however, it is the two pawls which are slightly displaced from each other in a longitudinal direction of the device, to give the same effect as shown in FIGS. 5(*a*) and 5(*b*). The arrangement of FIG. 5(*c*) can be simplified by employing just a single, but wider, sawtooth element 50. This is shown in FIG. 5(*d*).

Although in FIGS. 5(*a*)-5(*d*) two sawtooth elements 50 have been shown, it is possible to use more than two (e.g. three), in order to increase the locking resolution even further, without sacrificing strength and security. Where, e.g., three such elements 50 are used, either the elements themselves, or their associated pawls, will be displaced relative to each other, so that, while one pawl is engaged with the trough of a tooth of its sawtooth element, the second pawl will lie at one third of the distance between the trough and peak of a tooth of its sawtooth element, and the third pawl will lie at two thirds of the distance between the trough and peak of a tooth of its sawtooth element. This means that, in practice, as the second longitudinal member retracts into the first longitudinal member, the two (or three or more) pawls will one after the other, in sequence, engage the troughs of their associated teeth.

An example of an arrangement employing a single sawtooth element and three pawls, which are staggered in their spacing, is shown in FIG. 5(*e*).

Where more than one pawl lever is used, they will all be operated by the lock lever 56 shown in FIGS. 4(*a*) and 4(*b*). This could be achieved by simple extension of the section 56*d* of the lock lever.

In what has been described so far, it is necessary to keep the key turned in the lock while extending the second longitudinal member 12. This might seem to present an inconvenience to the user, especially since the second longitudinal member has to be extended against the force of the spring 60. However, an easy way of solving this potential problem is as follows (see FIGS. 6(*a*)-6(*d*)):

Firstly, as shown in FIG. 6(*a*), the device in its fully retracted state is offered up to the safe, so that the distal end of the right hand lateral member 14 contacts the right hand side-wall of the safe. Then (FIG. 6(*b*)) the key is turned in the lock and held there, while the second longitudinal member 12 is pulled out in the direction shown, so that the lateral members are wider than the width of the safe. Since the right hand lateral member 14 is held against the safe wall, the force of the spring 60 is easily overcome, while the key is still turned. Thirdly (FIG. 6(*c*)), the left hand lateral member 16 is offered up to the left hand side-wall of the safe and the device pushed fully forward, so that it touches the front wall of the safe. Finally (FIG. 6(*d*)), the left hand lateral member 16 is either simply released, or—as shown—force is applied to the two lateral members, as explained earlier. The device is then fully in situ against the safe.

It was said earlier that, ideally, both rear walls 36, 38 of the longitudinal members should touch the front wall of the safe. However, with the device as shown in FIGS. 6(*a*)-6(*d*) there is a small gap between the rear wall 38 of the second longitudinal member and the front wall of the safe. This is undesirable, since it might be possible for a thief to introduce some kind of bladed instrument into this gap, in order to pry the device away from the safe. To avoid this, a different cross-sectional configuration of the two longitudinal members may be employed, as illustrated in FIG. 7(*b*).

Figure 7A:
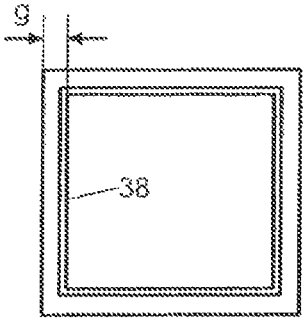
FIGS. 7(*a*)-7(*c*) are variants of a cross-sectional profile of first and second longitudinal members as employed in a security device in accordance with an embodiment of the present invention.
Figure 7B:
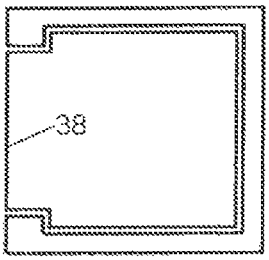
Figure 7C:
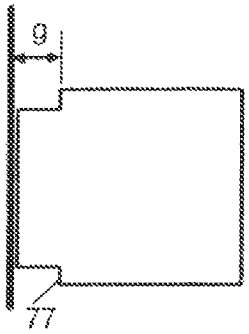

Firstly, however, we refer to FIG. 7(*a*), which shows the cross-section of the device as so far described and illustrated, in which the second longitudinal member 12 is fully housed inside the first longitudinal member 10. The afore-mentioned gap between the rear wall 38 of the second longitudinal member 12 and the front wall of the safe corresponds to the gap g shown in FIG. 7(*a*). To reduce the potential risk of this gap, a variant of this cross-section is as shown in FIG. 7(*b*). In this case a major part of the rear wall 38 of the second longitudinal member 12 now lies flush with the rear wall of the first longitudinal member, and will therefore be in direct contact with the safe wall, when the device is fitted (see FIG. 7(*c*)). It is true, of course, that a gap g still exists at the top and bottom of the rear wall 38 (see FIG. 7(*c*)), but this is quite shallow, rendering it more difficult for a thief to insert a prying instrument, with a view to prying the device away from the safe.

In order to reduce this risk still further, two variants of the FIG. 7(*b*) design will now be described with reference to FIGS. 8(*a*) and 8(*b*).

Figure 8A:
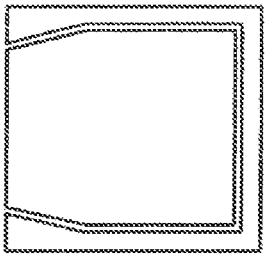
FIGS. 8(*a*) and 8(*b*) are further variants of a cross-sectional profile of first and second longitudinal members as employed in a security device in accordance with an embodiment of the present invention.
Figure 8B:
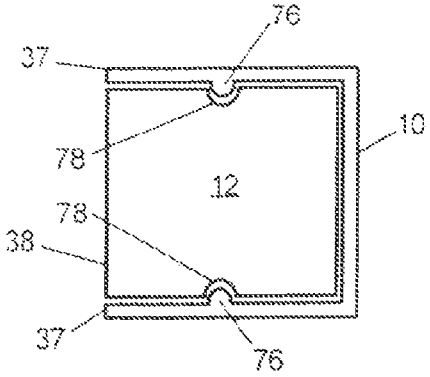

In FIG. 8(*a*), the shoulder 77 shown in FIG. 7(*c*) has been transformed into a slanting surface, which meets the back wall 38 of the second longitudinal member. The profile of the first longitudinal member at this point corresponds to that of the second longitudinal member. Thus now it is very difficult for a thief to insert an instrument between the front wall of the safe and this slanting surface and successfully pry the device away from the safe.

FIG. 8(*b*) goes even further than this and removes even the slanting surface. In this variant the first longitudinal member 10 has only three sides, the rear side 36 (see FIG. 1) being missing. In addition the cross-sectional profile of the second longitudinal member 12 is adjusted so that it is again rectangular, as in FIG. 7(*a*).

In FIG. 7(*c*), in order to keep the two longitudinal members in engagement with each other, a protrusion 76 is provided midway along the inside wall of the top and bottom sides of the first longitudinal member, and a corresponding keyway 78 is provided on the top and bottom sides of the second longitudinal member 12. To assemble the device, the second longitudinal member is inserted into the first longitudinal member, so that the protrusions 76 engage with the keyways 78. The second longitudinal member is then free to slide in and out of the first longitudinal member, without any risk that it will come away from the latter.

Instead of having protrusions 76 at both the top and bottom of the cross-section of the first longitudinal member, as shown in FIG. 8(*b*), there may be only one protrusion at the top or bottom.

The protrusion(s) may be either continuous over that part of the length of the first longitudinal member 10, which is expected to come into engagement with the second longitudinal member 12, or there may be one or more discrete protrusions at one or more points along the length, as just defined, of the first longitudinal member.

Clearly, in this embodiment, when the device is fitted up to the front wall of a safe, no gap—whether resulting from the presence of a shoulder or a slanting surface—will exist at any point between the front wall of the safe and the rear of the two longitudinal members, which is advantageous as far as security is concerned.

As already mentioned, the method of fitting the device to a safe shown in FIGS. 6(*a*)-6(*d*) preferably involves not only the action of the tension spring 60 (see FIG. 4), but also the application of a direct pressure against the lateral members 14, 16, in order to create a firm clamping action of the device against the side-walls of the safe (see FIG. 6(*d*)). Such direct pressure might be applied by the user pressing the two lateral members against the safe with his two hands. However, an alternative method of ensuring a tight clamping action will now be described.

Figure 9A:
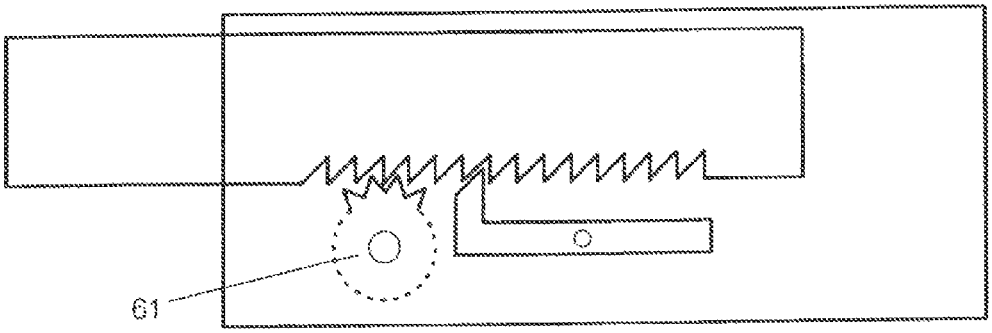
FIGS. 9(*a*)-9(*c*)
Figure 9B:
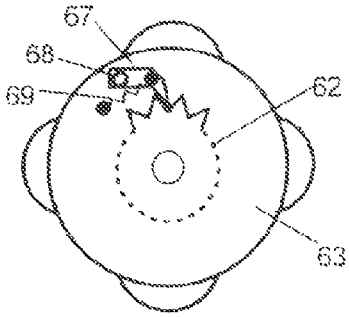
Figure 9C:
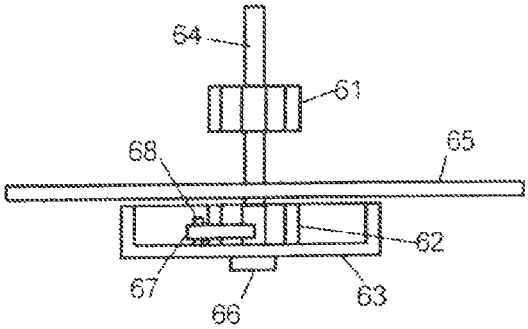

Referring to FIG. 9(*a*), this shows part only of the locking arrangement of FIG. 4, but it is assumed that the whole locking arrangement shown in FIG. 4 is included in FIG. 9(*a*). Added to this locking arrangement is a pinion 61, which is journalled in at least the front wall of the first longitudinal member 10 and engages with the teeth of the sawtoothed element 50. (Only a few teeth of the pinion 61 are shown, but it is understood that they are present all around the circumference of the pinion.) Thus, the sawtoothed element 50 now acts also as the rack of a rack-and-pinion mechanism. Now, instead of exerting hand pressure against the transverse member 14, 16, as in FIG. 6(*d*), the user simply allows the tension spring 60 to retract the second longitudinal member 12 as far as it will go, then turns the pinion 61 clockwise, thereby moving the second longitudinal member 14 in slightly more, compressing the ribbing 18, 20 (see FIG. 1) until the device is tight against the walls of the safe. To make it possible for the user to turn the pinion 61 a knob (not shown) is provided at the front of the device.

As things stand as shown in FIG. 9(*a*), the user could also turn the pinion 61 counterclockwise, which would try to pull the second longitudinal member 12 out of the first longitudinal member 10. Indeed, a thief could attempt to do this very thing, in order to make it easier to pull the device away from the safe. To avoid this possibility, FIGS. 9(*b*) and 9(*c*) show front and top views of a knob arrangement for operating the pinion 61. This knob arrangement employs a free-wheeling mechanism, which make it possible for the pinion to be turned clockwise only.

The free-wheeling mechanism comprises a ratchet 62, which is accommodated within the profile of a knob 63, but is not fixed thereto, and is attached to the same shaft 64 as the pinion 61. The knob 63 has projections around its circumference, in order to provide a better grasp for the user. Like the pinion 61, the ratchet 62 is shown with only a few representational teeth, but in actuality has teeth all around its circumference. The shaft 64 passes through the front wall 65 of the first longitudinal member 10 and through the center of the knob 63, where it is capped by an end-piece 66. Also provided within the profile of the knob 63 is a pawl 67, which is pivotably attached at one end to the wall of the knob at a point 68 and at its other end engages with the teeth of the ratchet 62. A tension spring 69 is attached to the pawl at one end and to the wall of the knob at the other.

In order to provide a sufficiently high torque to move the transverse members closer to each other against the walls of a safe, it is desirable that the diameter of the knob be large and the diameter of the pinion 61 be small. However, in order to increase the mechanical advantage of the rack-and-pinion mechanism further, a variant of this arrangement (not illustrated) has the knob more centrally located between the top and bottom surfaces of the first longitudinal member 10 and engaging with the pinion 61 through a reduction gear train.

Instead of using the sawtoothed element 50 as the rack, a separate dedicated rack may be employed.

Figure 10:
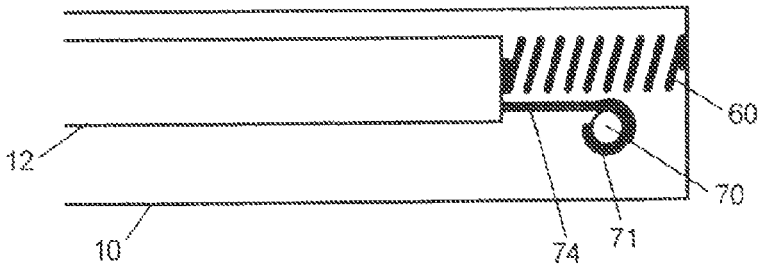

Yet another locking mechanism is shown in FIG. 10. This mechanism likewise has all the components of FIG. 4, but in addition has a spindle 70, which is journalled in at least the front wall of the first longitudinal member 10 and is fixed to a knob at the front of the device, as in the FIG. 9 arrangement. This time, however, a strong cord 74 is attached at one end to the inner end of the second longitudinal member 12 and at the other member to a point on the spindle. It is assumed in FIG. 10 that the second longitudinal member is fully retracted and that many turns of cord are wrapped around the spindle 70. When the second longitudinal member 12 is pulled out in order to attach the device to a safe, those turns of cord will unwind. Preferably, a few turns still exist even at the extreme of extension of the second longitudinal member out of the first longitudinal member. Now, after the device has been offered up to the safe and the spring 60 has been allowed to retract the second longitudinal member as far as it will go, given the outside dimensions of the safe, the knob (not shown) is turned clockwise, thereby causing more of the cord to be wrapped around the spindle 70. As the cord tightens and the second longitudinal member 12 becomes more retracted, the ratchet mechanism shown in FIG. 4 comes further into play and eventually locks the second longitudinal member into place relative to the first longitudinal member.

It will be noted that, as the second longitudinal member 12 retracts of its own accord under the action of the spring 60, since the spindle 70 is not being turned, there will be a tendency for the cord to bunch up inside the device, until the spindle is eventually turned. In order to avoid this bunching effect, an embodiment of the invention envisages the use of a spring, which biases the spindle into its clockwise-turning direction. Thus, under the circumstances just described, as the second longitudinal member 12 retracts of its own accord, the spindle will at the same time rotate clockwise, causing the gathering cord to be wrapped around the spindle. A suitable spring to achieve this effect is a torsion spring, which is attached at one end to the spindle 70 and at its other end to the first longitudinal member 10. The force of the torsion spring need only be enough to prevent bunching of the cord 74 inside the first longitudinal member and will be significantly less than the force of the tension spring 60.

Figure 11:
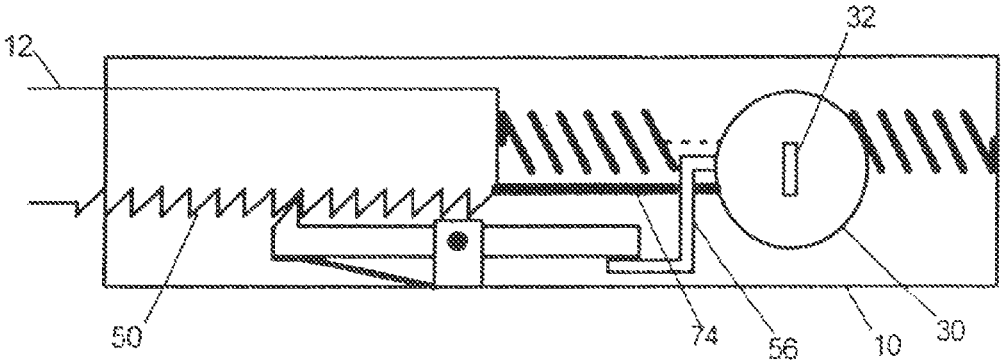
FIG. 10 and FIG. 11 are further embodiments of a locking mechanism as employed with a security device in accordance with an embodiment of the present invention.

A further alternative to the locking mechanisms just described is, again, based on the FIG. 4 arrangement, but this time uses the existing lock 30 to achieve the turning effect of the knob described in connection with FIGS. 9 and 10. This is shown in FIG. 11, which is the same as FIG. 4(*a*), but includes in addition the cord 74 described in connection with FIG. 10. The cord is wrapped around a spindle housed inside the lock 30. In use, in order to tighten the cord and pull the second longitudinal member 12 as far as possible into the first longitudinal member 10, the lock key is inserted into the slot 32, where it is then pushed into a second position inside the lock. The lock has two positions for the key: a first position, which enables the user to move the pawl 53 out of engagement with the sawtoothed element 50, and a second position, which enables the user to turn the key continually clockwise, thereby wrapping more and more of the cord onto the spindle inside the lock and pulling the second longitudinal member deeper into the first longitudinal member. Once the second longitudinal member has retracted as far as it can, the key is taken out, until such time as the device is to be taken away from the safe. At that point the key is reinserted into the slot, but this time only up to its first position, and turned so as to operate the lock lever 56, which in turn brings the pawl out of engagement with the sawtoothed element 50. This allows the user to extend the second longitudinal member 12 further out of the first longitudinal member 10 and to pull the device away from the safe.

So far it has been assumed that the security device according to the invention will be used with a stand-alone safe. There are, however, many safes which are mounted on a wall of a hotel room (so-called "wall safes"). These are more or less flush with the wall, but usually have some sort of lip, against which the security device of the present invention can be mounted. This means that, if the embodiments described so far are employed with such safes, it will be impossible to abut the device right up to the front wall of the safe. This is because the lateral members 14, 16 are fairly long—deliberately so, in order to ensure a good grip between those extensions and the side-walls of the safe. A second embodiment (see FIGS. 12(*a*) and 12(*b*)) solves that problem.

Figure 12A:
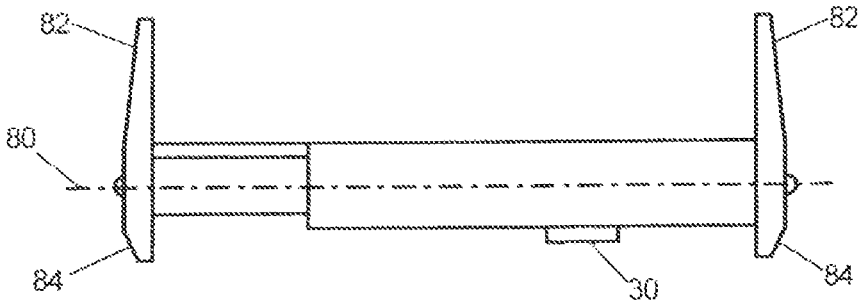
FIGS. 12(*a*) and 12(*b*) are plan views of two modes of use of a security device in accordance with a second embodiment of the present invention.
Figure 12B:
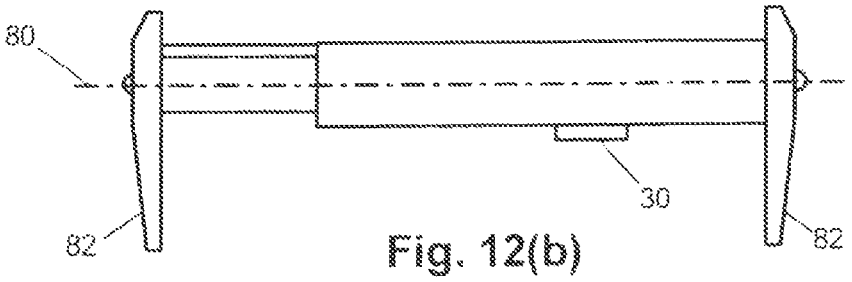

In FIGS. 12(*a*) and 12(*b*) the lateral members are not integral with their respective longitudinal members, but are separate items secured to those longitudinal members in such a way that they can be rotated 180° about an axis 80 parallel to the longitudinal axis of the longitudinal members. Thus, in FIG. 12(*a*) the lateral members have been rotated so that their long sections 82 face away from the front of the device containing the lock 30, i.e. face toward the safe. This configuration suits the type of safe which is secured inside a cupboard. Conversely, in FIG. 12(*b*) the lateral members are rotated so that their short sections 84 face away from the front of the device, i.e. toward the safe. This suits a wall-mounted safe. Note that the length of the short sections is ideally such that it allows at least the first main section 10 to lie flat against the front of the safe, when the device is deployed. FIGS. 12(*a*) and 12(*b*), however, assume the use of the FIG. 7(*b*) or FIG. 8(*a*) configuration, in which the second longitudinal member is also in contact with the front wall of the safe.

While the arrangement just described works in principle, in practice it could pose a security threat. This is because both modes of use of the device leave at the front of the device an overhang of the lateral members. In the case of FIG. 12(*a*) the overhang is the short extension section 84, while in the case of FIG. 12(*b*) it is the long extension section 82. This could enable a thief to interpose a rigid rod or beam of some sort between the overhangs, which would prevent the second longitudinal member 12 from retracting into the first longitudinal member 10. In the unlikely event that the thief was then able to somehow pull the device away from the safe, he might then be able to open the safe, steal the valuables, then lock the safe again and refit the device onto the safe. While this would not be easy, it is conceivable that it could be done.

It is worth mentioning at this point that this desirability of eliminating an overhang is why in FIG. 1 it was preferred that the shoulder 17 be flush with the rear surface 38 of the second longitudinal member 12 and not flush with its front surface. If the shoulder were flush with the front surface, there would be two shoulders—the shoulder 17 already mentioned and the shoulder present at the left-hand end of the first longitudinal member 10—in the device when deployed with a safe. These shoulders represent overhangs, between which a thief could wedge a rigid bar, preventing the device from retracting. He might then be able to refit the device back onto the safe, leaving the user unaware that any attempt at theft had been made.

In order to avoid the potential security risk of the FIG. 12 arrangement, a third embodiment involves the configuration shown in FIGS. 13(*a*)-13(*d*).

In FIG. 13(*a*) the second longitudinal member 12 has at its free end a stub of a lateral member 90. (There is an identical arrangement at the free end of the first longitudinal member 10.) This corresponds to the short lateral member 84 shown in FIGS. 12(*a*) and 12(*b*). This stub is hollow and has a small rectangular window 92 in its inner side face 94 for reasons to be explained. The stub also has on its inner face the ribbing 18 (see FIG. 1). FIG. 13(*b*) shows an extension piece 96, which fits into the hollow stub 90 and acts as the long lateral member 82 shown in FIGS. 12(*a*) and 12(*b*). The extension piece 96 is in three parts, namely a small cross-section part 96*a*, a larger cross-section part 96*b*, which also has the ribbing 18, and a resilient part 96*c*. The resilient part 96*c* is anchored to either the part 96*a* or the part 96*b*, or both. Preferably, the resilient part 96*c* extends into the part 96*b* through a slot formed therein and is fixed by some suitable securing means to the part 96*b*. The resilient part 96*c* has a tongue portion 96*c*-1 and a latch portion 96*c*-2. The latch portion has a sloping profile at its lower end, which gives way to a horizontal profile connecting the sloping profile to the tongue portion 96*c*-1. In addition, a recess is formed in the inner surface of the part 96*a*. This is shown in FIG. 13(*b*) and also FIG. 13(*c*), which is an underside view showing the part 96*a*, the recess 98 and the resilient part 96*c*.

In use, when the long extension section 82 is required, the extension piece 96 is inserted into the opening of the stub 90 until a shoulder 100 of the extension piece 96 rests adjacent to the top of the stub 90. As the extension piece 96 is being inserted, the resilient part 96*c* is moved in the direction of the arrow shown in FIG. 13(*b*) and rides over the inside wall 102 (see FIG. 13(*a*)) of the stub 90. On its way down it may, depending on the width of the window 92 relative to the width of the resilient part 96*c*, momentarily relax into the window 92, but then continues on down, until the latch portion 96*c*-2—and specifically the horizontal profile just described—lodges underneath the inside surface of the rear wall 38 of the second longitudinal member 12. This situation is illustrated in FIG. 13(*d*).

In order to release the extension piece 96, a thin instrument such as a screwdriver blade is inserted into the window 92 and used to press the resilient part 96*c* again in the direction shown in FIG. 13(*b*), and the extension piece 96 is subsequently removed. The recess 98 has sufficient depth to allow the resilient part 96*c* to be fully disengaged from under the inside surface of the rear wall 38 of the second longitudinal member 12.

The window (and, consequently, the resilient part 96*c*) are advantageously situated on the inner surface 94 of the stub 90, since then the window is hidden when the device is in situ against the wall of a safe, rendering the device more secure.

A particularly advantageous fourth embodiment of the security device will now be described with reference to FIGS. 14(*a*) and 14(*b*).

As in the foregoing embodiments, this fourth embodiment comprises two longitudinal members 10, 12, the member 12 having a saw-toothed element 50 on its outer surface—that is, the surface of the member 12 facing away from the front of the safe. The longitudinal member 10, which is shown in thicker lines for ease of identification, has at one end a raised portion comprising a pair of raised opposing side-walls 110, to which there is swivellably attached a swivellable clamping member 112. Also provided on the longitudinal member 10 at a point longitudinally spaced apart from the side-walls 110 of the raised portion and extending away from the safe, is a locking-tab member 118. The locking-tab member 118 has a tab 120, which co-operates with part of a lock device, which will be described below.

Figure 14A:
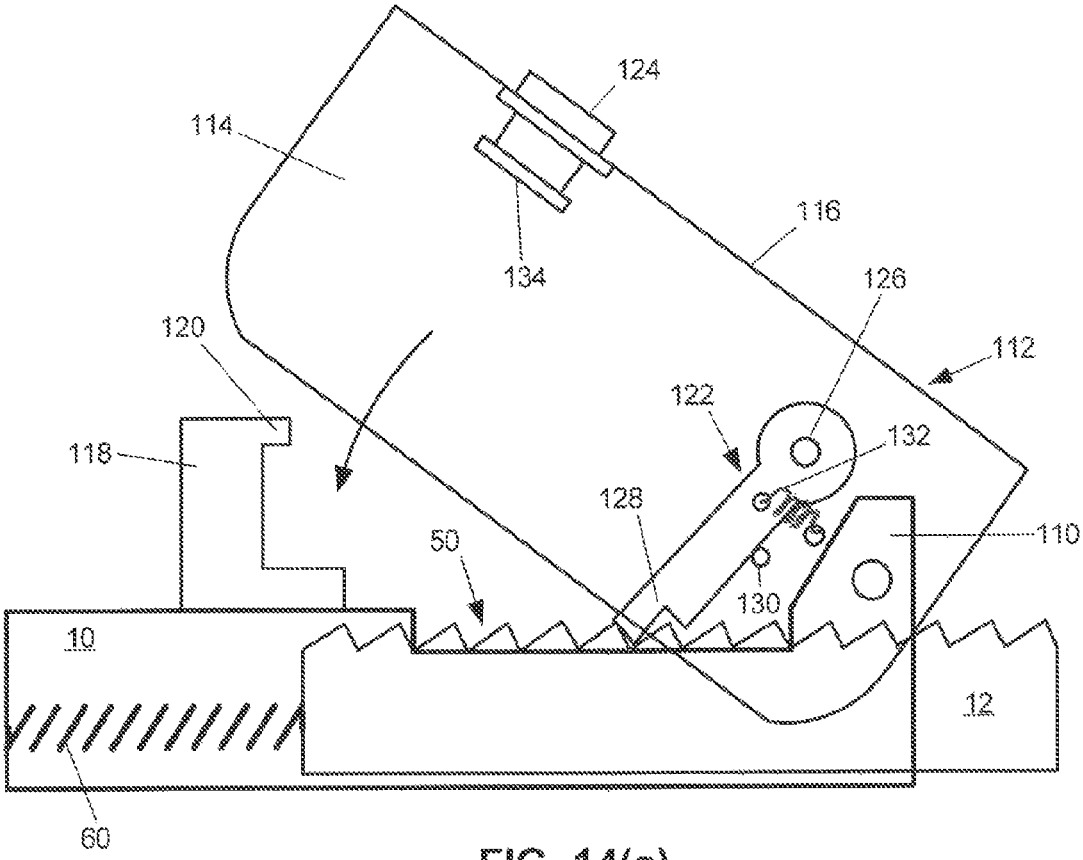
FIGS. 14(*a*) and 14(*b*) are side views showing different stages in the use of a security device according to a fourth embodiment of the present invention.
Figure 14B:
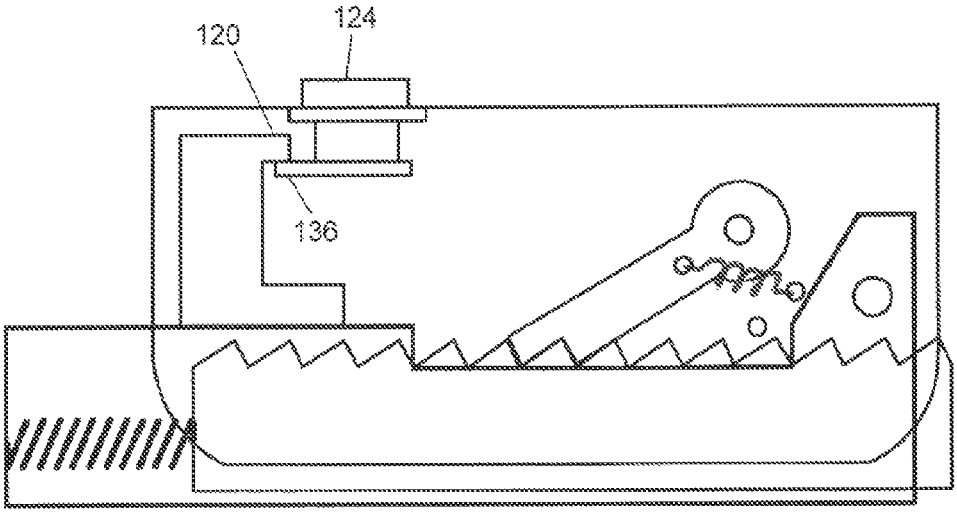

The clamping member 112 has opposing side-walls 114, of which only one is shown in FIG. 14(*a*), and a top wall 116. Swivellably attached to the side walls 114 is a pawl member 122 and a lock 124 is provided in the top wall 116 of the clamping member 112. The pawl member 122 has a pin 126 at its one end, which is journalled in the side-walls 114, while at the other end of the pawl member a shoulder portion 128 is provided, which substantially matches the profile of the teeth of the saw-toothed element 50. A stop 130, which may be a pin journalled in the side-walls 114 like the pin 126, is provided to limit the movement of the pawl member 122 under the action of a biasing spring 132. The lock 124 accepts a key (not shown), whereby it can be operated. Turning the key rotates a lock operating member 134, the action of which will be described below.

FIG. 14(*a*) shows the security device in its unlocked state. That is, the security device has been offered up to the front of a safe, with the two longitudinal members 10, 12 extended a short way against the action of the internal spring 60. Once the lateral members (not shown) on the ends of the longitudinal members are slightly wider than the width of the safe, the longitudinal members are released, allowing the spring 60 to bring the two longitudinal members into greater retraction with respect to each other, whereby the lateral members are clamped against the sides of the safe with a force determined by the spring constant of the spring 60. In this state the clamping member 112 is in its open ("second") position.

The user then swivels the clamping member 112 counter-clockwise, as shown by the arrow in FIG. 14(*a*), until the shoulder 128 of the pawl member 122 engages with one of the teeth of the sawtoothed element 50. At that point the clamping member is still in a slightly open position. The user then pushes the lock end of the clamping member fully into its closed ("first") position, as shown in FIG. 14(*b*). While the user is doing this, the shoulder 128 of the pawl member moves the sawtoothed element 50 further into the longitudinal member 10, causing the lateral members to become clamped more tightly against the side-walls of the safe. At this point the user then operates the lock 124, so as to rotate the lock operating member 134. The lock operating member 134 has a lug 136, which engages with the tab 120 of the locking-tab member 118. The result is a security device which is tightly clamped against the safe, and whose clamping member 112 cannot, without the key, be opened to release the clamping action against the safe.

In practice, it is ensured that the pushing action of the shoulder 128 against the tooth of the sawtoothed element 50 causes a longitudinal movement of the longitudinal member 12 into the longitudinal member 10 within the range of possible movement of the lateral members from their position in FIG. 14(*a*) to their position in FIG. 14(*b*). This range of movement is determined by the resilience of the gripping surface on the inner surfaces of the lateral members and any resilience inherent in the arms of the lateral members, and even in the longitudinal members, themselves. This range of movement will likely depend on whether or not the longitudinal members are brought right up to the front wall of the safe. This present embodiment allows for the longitudinal members to be offered up to, for example, a locking key pad on the front wall of the safe. This will usually mean leaving a space between the longitudinal members and the safe front wall, which could allow a little more resilience in the lateral members, and a consequently slightly greater range of movement of the gripping surfaces under the action of the shoulder 128 of the pawl member 122.

The location of the backstop 130 also plays a part in this range of movement of the sawtoothed element. Thus, if it is placed too far back near the pivot point of the clamping member 112 to the longitudinal member 10, there is the risk that closing the clamping member will try to force too much movement of the sawtoothed member into the longitudinal member 10, and in an extreme case the clamping member may not even fully close. On the other hand, placing the backstop 130 too near the lock 124 could have the opposite effect. The optimum position of the backstop can be arrived at by simple trial and error. Alternatively, it is possible to make the backstop position adjustable.

Incidentally, offering the longitudinal members up to the key pad of a safe as just described has two advantageous effects. Firstly, it can prevent a thief from operating at least some of the buttons on the key pad. Secondly, even if other buttons can be operated, such as to unlock the safe door, that door cannot be opened anyway because of the presence of the security device clamped tightly against the side-walls of the safe.

To remove the security device from the safe, the user follows the reverse sequence of steps. Thus he firstly operates the lock 124, so as to turn the lug 136 away from the tab 120. This allows the user to move the clamping member out of its closed position into its open position. The two longitudinal members are then extended slightly, so that the two lateral members come clear of the side-walls of the safe, and the security device is then moved away from the safe and the longitudinal members are allowed to retract into each other to the maximum possible extent.

Figure 15A:
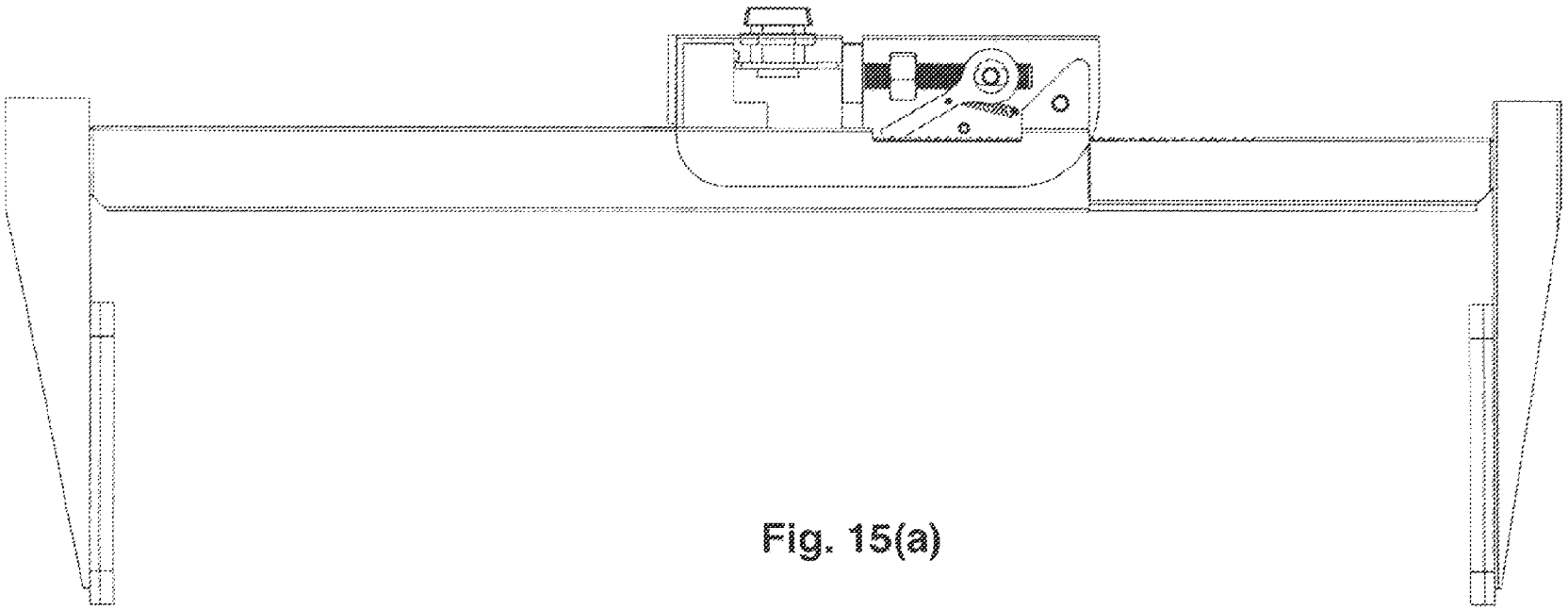
FIGS. 15(*a*) and 15(*b*) are plan and perspective views, respectively, of a variant of the fourth embodiment.
Figure 15B:
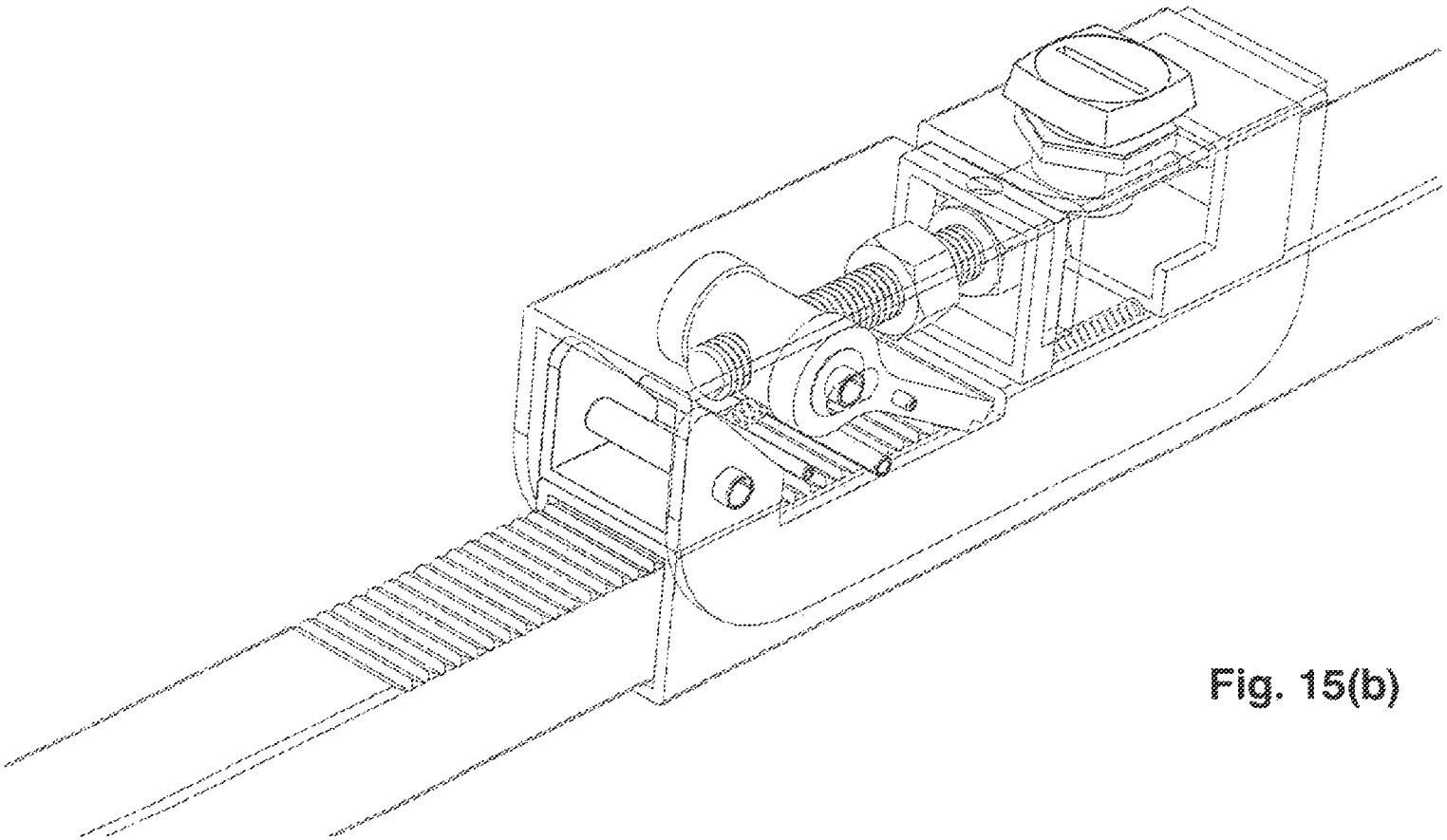

A variant of the fourth embodiment will now be described with reference to FIGS. 15(*a*) and 15(*b*) and FIGS. 16(*a*)-16(*c*). FIG. 15(*a*) provides a top view of the whole security device (i.e. top view when in use), while FIG. 15(*b*) gives a clearer perspective view of the spatial relationships between the various components of the clamping member of this variant. In both these drawings the clamping member is shown transparent, so that the inside components can be clearly seen. In practice, however, the clamping member will generally be opaque. The variant will now be explained chiefly with reference to FIG. 16(*a*), which is a simplified representation.

Figure 16A:
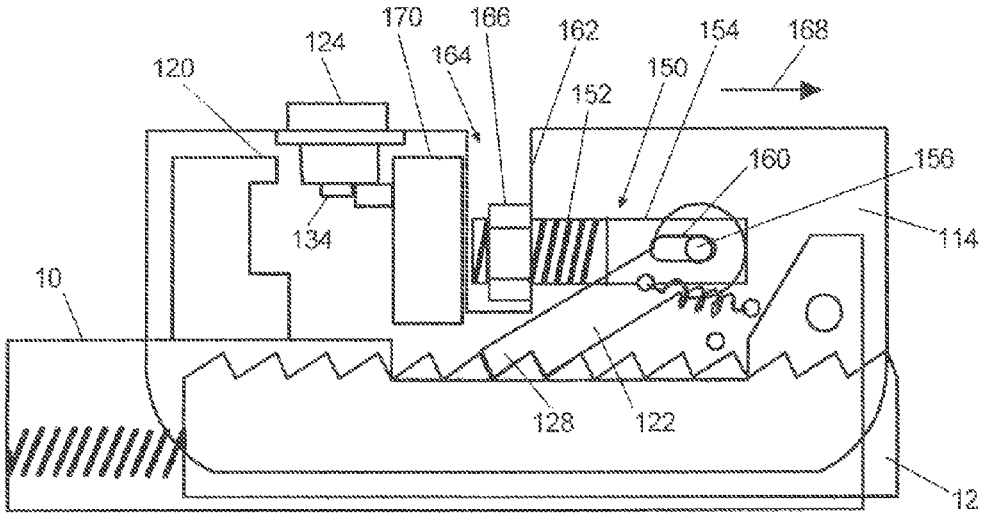
FIG. 16(*a*) is side view of a variant of the fourth embodiment, with FIGS. 16(*b*) and 16(*c*) as top views of a lock member as employed in the variant embodiment.
Figure 16B:
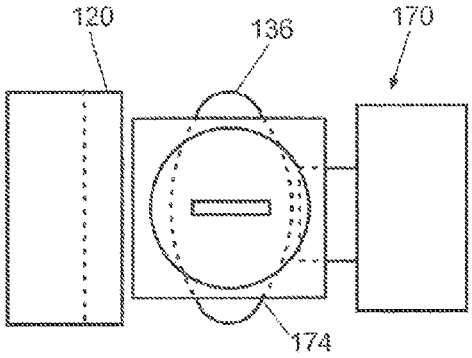
Figure 16C:
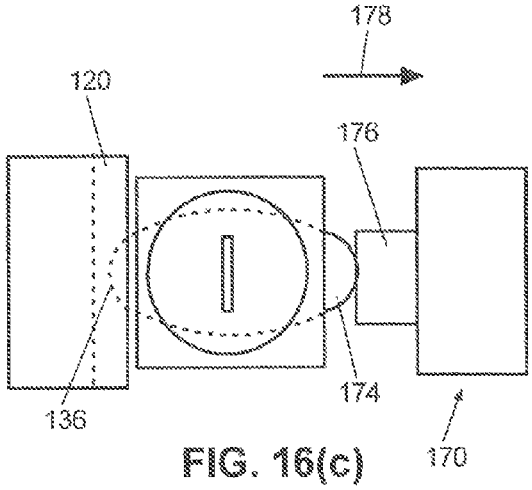

FIG. 16(*a*) is similar to FIG. 14(*b*), except for the following differences. Firstly, the lock 124 is shown still in its unoperated state, so that the lug 136 is not located underneath the tab 120. Secondly, a vernier arrangement is provided. Thirdly, a cover member 170, which will be further described below, is included.

The vernier arrangement comprises a bolt 150 with a threaded portion 152 and a shank portion 154. (Alternatively, the whole of the bolt may be threaded.) The shank portion has passing through it a pin 156, which passes through the swivel end of the pawl member 122 and into slotted holes 160 provided in the side-walls 114 of the clamping member 112. The end of the threaded portion 152 of the bolt 150 passes through a hole provided in a wall 162 of the clamping member, which connects the two side-walls 114. The wall 162 also forms part of a notch 164 formed in the side-walls 114. The vernier arrangement comprises also a nut 166 on the end of the threaded portion 152 of bolt 150.

In use, once the clamping member 112 has been moved from its open position to its closed position, so that the longitudinal member 12 has been moved further inside the longitudinal member 10 by the shoulder 128 of the pawl member 122, a spanner is taken and is used to advance the nut 166 along the thread in the direction shown by the arrow 168. Due to the reaction of the nut 166 against the wall 162, tightening the nut has the effect of moving the swivel end of the pawl member 122 in a direction opposite to the arrow 168, so that the pin 156 moves along the slotted hole 160 in this same opposite direction. This clamps the lateral members even tighter against the side-walls of the safe, making it even more difficult for a thief to remove the security device.

In order to limit the amount of adjustment that can be made by turning the nut 166, a second nut may be included at the other side of the notch wall 162, as shown in FIGS. 15(*a*) and 15(*b*).

In order to provide enhanced protection against a potential thief, this variant of the further embodiment employs a means for preventing access to the nut 166, once the device has been installed. This is achieved by providing a cam on the lock operating member 134 along with the lug 136. Now, when the lock 124 is operated, it not only engages the lug 136 with the tab 120, but it also moves a diametrically oppositely placed cam in the direction of the arrow 168. This causes the cover member 170 to be moved longitudinally in the direction of arrow 168, thereby covering at least most of the part of the notch occupied by the nut 166. This prevents a potential thief from loosening the nut.

The cover member 170 is U-shaped, so as to block access to the notch from three sides. To allow the cover member 170 to relax back into its normal uncovering position when the lock 124 is unlocked, some form of a biasing element (e.g. a leaf spring) is included between the cover member 170 and the clamping member 112.

FIGS. 16(*b*) and 16(*c*) show the lock 124 in its unlocked and locked states, respectively. FIG. 16(*b*) is the unlocked state, in which the lug 136 and the cam 174, which operates the cover member 170, point toward respective side-walls 114 of the clamping member 112. In the locked state of FIG. 16(*c*), the lug 136 is engaged with the shoulder 120, while the cam 174 engages with a cam follower 176 formed on the cover member 170, moving it in the direction of the arrow 178.

(Incidentally, the perspective view of FIG. 15(*b*) is similar to a perspective view of FIG. 14(*b*), except for the absence of the vernier arrangement and the nut cover member.)

The fourth embodiment in both of its versions may incorporate also features from the earlier embodiments. Thus, for example, the features of FIGS. 7(*a*)-7(*c*), of FIG. 8(*a*) or 8(*b*), of FIGS. 12(*a*) and 12(*b*) or of FIGS. 13(*a*)-13(*d*) may also be used in the fourth embodiment.

As with the previous embodiments, in the fourth embodiment also, even if a thief were able to pry the security device away from the safe, the second longitudinal member would automatically retract as far as possible into the first longitudinal member. Due to the fact that the clamping member is still in its first position, with the shoulder 128 of the pawl member 122 still engaging with the teeth of the sawtoothed element 50, the thief could not pull the second longitudinal member out of the first longitudinal member in order to refit the security device to the safe. This would alert the user of the security device to the fact that the security of the safe has been compromised.

FIG. 15(*a*) shows the clamping member and the sawtoothed element as being on the outward facing side of the first and second longitudinal members, i.e. the side facing away from the safe. However, it is equally possible to provide these components on either the upward or downward facing sides of the longitudinal members.

Figure 17:
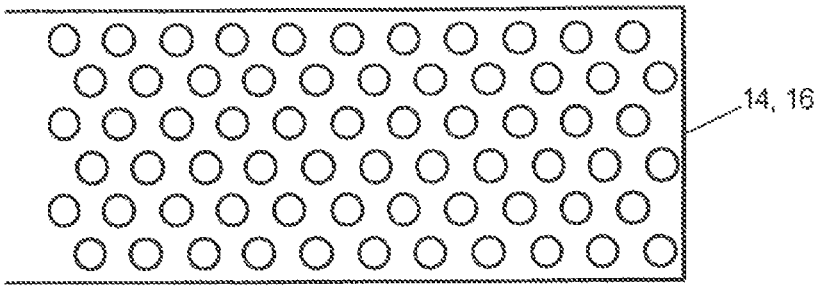
FIG. 17 is a view of an inner-facing surface of a lateral member employed in a security device in accordance with an embodiment of the present invention, the inner-facing surface comprising an alternative to the ribbing arrangement shown in FIG. 1.
Figure 13A:
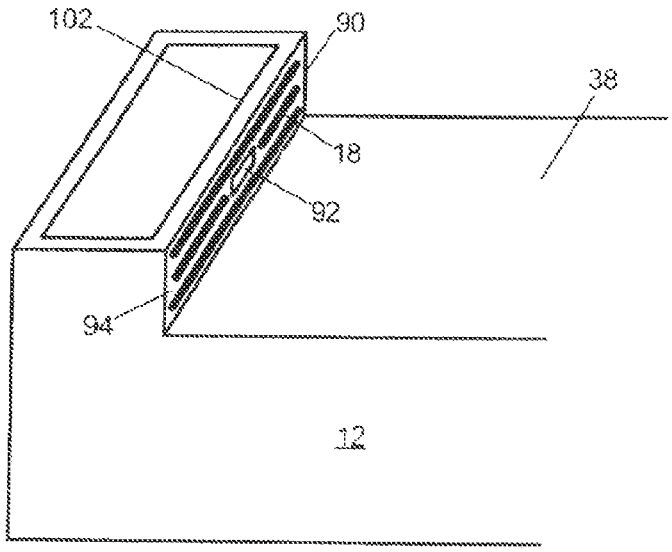
FIGS. 13(*a*)-13(*d*) are various views of a security device according to a third embodiment of the present invention.
Figure 13C:
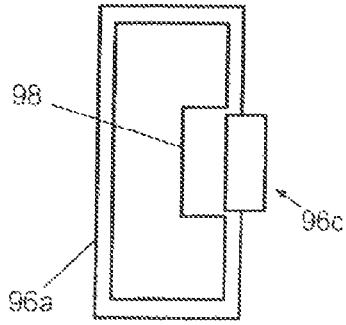
Figure 13B:
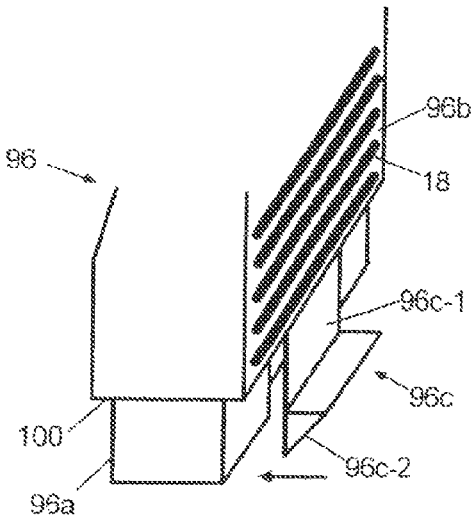
Figure 13D:
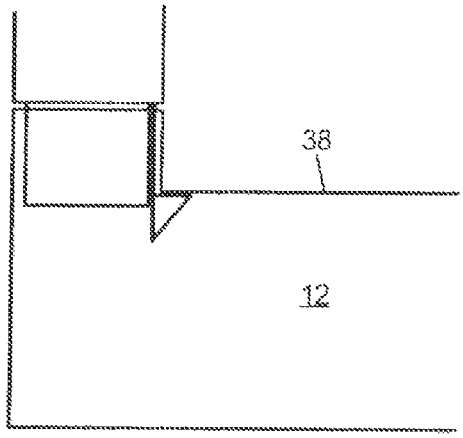

Although it has so far been assumed that the inside walls 40, 42 of the lateral members 14 and 16 will be provided with ribbing 18 and 20, other forms of grip are possible, which can similarly assist the clamping action of the device against the side-walls of a safe. One such alternative form is a matrix of raised dots, somewhat similar to the rubbing pattern of a cheese grater. An example of this is illustrated in FIG. 17. Another possibility is a series of rows of ribs, such as shown in FIG. 1, but in which each row is divided into two or more sections of ribbing. Where ribbing is employed, of whatever form, the ribs will be orientated parallel to the front face of the safe, with which the device is to be used, and not perpendicular thereto, in order to make it difficult to pull the device away from the front face.

The pawl and sawtooth version of the locking mechanism has assumed the use of a leaf spring or compression spring to keep the pawl in engagement with the teeth of the sawtooth element. As an alternative to this, a torsion spring may be employed. Where a torsion spring is used in the FIG. 4 embodiment, one end of this will be anchored to a wall of the first longitudinal member, while the other end is fixed to end of the pawl lever 52. Where a compression spring is employed, the lower end will rest against the bottom wall of the first longitudinal member 10 and the other end will abut the underside of the pawl lever 52. As with the leaf spring, both of these other forms of spring are arranged to bias the pawl 53 against the teeth of the sawtooth element 50.

While all of the above-described embodiments relate to a security device for a safe, in practice the security device is especially suited to the protection of a hotel safe. Assisting in this regard is the fact that the device in its unused state occupies a relatively small footprint. This is primarily due to the fact that, in all of the embodiments, the second longitudinal member is initially fully retracted into the first longitudinal member by the spring 60. This means that it is a simple matter for a hotel guest to insert the device into a small cupboard, or other restricted space, containing the safe, after which the device need be expanded only far enough to allow the lateral members to be fitted against the side-walls of the safe. This is an initial clamping stage of the device, the clamping force here being determined solely by the spring constant of the spring 60. In the fourth embodiment particularly, a second clamping stage then involves the user closing the clamping member 112, thereby forcing the second longitudinal member further into the first longitudinal member, which causes an enhanced clamping action of the lateral members against the safe side-walls. Thereupon the clamping member is prevented from being opened by operation of the lock 124. If necessary, the user can enhance the clamping action further still in the fourth embodiment by adjustment of the nut 166. The result is a security device, which blocks the way into the safe and can only be removed with very great difficulty. Indeed, it is unlikely that a thief would even attempt to remove the device, firstly because of its very tight clamping against the safe, and secondly because most such thieves are opportunist and are unlikely to want to spend time breaking into this particular safe, when it would be far easier to turn their attention to a different one—one not protected by the security device of the present invention.

It has been described how, due to the retraction of the device in the unlikely event that it has been pried away from a safe by a thief, and the inability of the thief to extend the device again and refit it to the safe, the owner of the device becomes automatically aware that someone has tampered with the device and possibly stolen goods from the safe. In most circumstances that will be a good enough indication of such tampering. However, it is also envisaged by embodiments of the present invention to provide a further indication of tampering. This is especially useful where a battery and circuitry are already present in the device—e.g. where the lock is a biometric lock, as described earlier—but can be implemented even with a conventional lock. The further indication would be achieved by including a tamper alarm in the device, which would manifest itself either as a visible alarm indication or an audible alarm indication, or both.

As regards materials, which may be used for the security device, anything which is at the same time light yet strong can be employed. Hence, a metal such as aluminium could be used for the first longitudinal member 10 and possibly also for the lateral members 14, 16. As regards the second longitudinal member 12, this may be solid in cross-section or hollow. If solid, then aluminium may be used for this member also, or a strong plastics material. If hollow, aluminium would be more suitable than plastics. On the other hand, where weight is not so much at a premium, steel would be an even stronger material and could be used for all parts of the device except the ribbing. This might be suitable where the device was to be used with a safe larger than a typical hotel safe, in which case the device may not need to be portable.

Although automatic retraction of the second longitudinal member into the first longitudinal member has been described as occurring due to the use of a tension spring, an alternative is to use a length of very strong elastic cord.

The foregoing description has been given by way of example only and it will be appreciated by a person skilled in the art that modifications can be made without departing from the scope of the present invention.

What is claimed is:

1. A hotel safe security device for hindering the unauthorized opening of safes, the device comprising:

a first longitudinal member and a second longitudinal member, the second longitudinal member being retractably co-operable with the first longitudinal member;

first and second lateral members at respective outer ends of the first and second longitudinal members, the first and second lateral members being for clamping against side-portions of the safe;

a resilient member attached at one end to the first longitudinal member and at its other end to the second longitudinal member, the resilient member being such as to bias the second longitudinal member into retraction with respect to the first longitudinal member, and a locking mechanism for locking the first longitudinal member to the second longitudinal member in a clamped state of the device against the safe, the locking mechanism including— a sawtooth element as part of the second longitudinal member, a rigid pawl member having a first end, which is pivotably attached to the first longitudinal member and a second end, which is engageable with a tooth of the sawtooth element, and a swivellable clamping member, which is swivellably attached to the first longitudinal member, the swivellable clamping member being selectively swivellable to a first position, which is a clamping-enhancing position, and to a second position, which is a non-clamping-enhancing position, the first end of the rigid pawl member being swivellably attached to the swivellable clamping member and biasing means being provided to bias the second end of the rigid pawl member toward the sawtooth element, the locking mechanism being such that, when the safe security device is in place against a safe and the swivellable clamping member is swiveled from its second position to its first position, the second end of the rigid pawl member, by engagement with a tooth of the sawtooth element, moves the second longitudinal member into further retraction with respect to the first longitudinal member, thereby tightly clamping the lateral members to the sides of the safe.

2. A safe security device according to claim 1, wherein the locking mechanism comprises a lock device, which is attached to the swivellable clamping member and has a lug, which can be turned by operation of the lock device when the swivellable clamping member is in its first position, the lug engaging with the first longitudinal member and thereby locking the swivellable clamping member into its first position.

3. A safe security device according to claim 1, wherein inner surfaces of the first and second lateral members are provided with a gripping surface for establishing a firm grip with the side-portions of the safe.

4. A safe security device according to claim 3, wherein the gripping surface is formed of a resilient material.

5. A safe security device according to claim 4, wherein the gripping surface comprises a two-dimensional array of raised points.

6. A method of use of a safe security device, the security device being as defined in claim 2, comprising:

offering the security device up to the safe, so that the first and second lateral members are adjacent to the sides of the safe and spaced therefrom, the swivellable clamping member being in its second position;

allowing the first and second longitudinal members to retract with respect to each other, thereby causing the first and second lateral members to grip the sides of the safe under the action of the resilient member;

moving the swivellable clamping member from its second position to its first position; and operating the lock device, so that the lug engages with the first longitudinal member.

7. A method of use of a safe security device according to claim 6, including the steps of, when access to the safe contents is desired, operating the lock device, so that the lug comes out of engagement with the first longitudinal member;

moving the swivellable clamping member from its first position to its second position;

moving the first and second longitudinal members out of retraction with respect to each other, so that the first and second lateral members come clear of the sides of the safe;

pulling the security device away from the safe, and allowing the first and second lateral members to retract with respect to each other.

* * * * *